US012467253B2

(12) United States Patent
Nakanishi

(10) Patent No.: US 12,467,253 B2
(45) Date of Patent: Nov. 11, 2025

(54) FOUNDATION PACKING

(71) Applicant: Joto-Vent System USA, Inc., Redmond, WA (US)

(72) Inventor: Hiroyuki Nakanishi, Osaka (JP)

(73) Assignee: Joto-Vent System USA, Inc., Redmond, WA (US)

( * ) Notice: Subject to any disclaimer, the term of this patent is extended or adjusted under 35 U.S.C. 154(b) by 330 days.

(21) Appl. No.: 18/188,192

(22) Filed: Mar. 22, 2023

(65) Prior Publication Data

US 2023/0392369 A1 Dec. 7, 2023

(30) Foreign Application Priority Data

Jun. 3, 2022 (JP) ..... 2022-090850

(51) Int. Cl.
*E04B 1/70* (2006.01)

(52) U.S. Cl.
CPC ..... *E04B 1/7069* (2013.01)

(58) Field of Classification Search
CPC ..... E04B 1/7069
See application file for complete search history.

(56) References Cited

U.S. PATENT DOCUMENTS 3,949,657 A * 4/1976 Sells ..... F24F 7/02 454/365

FOREIGN PATENT DOCUMENTS

| | | | |
|---|---|---|---|
| JP | 3079777 | U | 8/2001 |
| JP | 1260892 | S | 1/2006 |
| JP | 3848523 | B2 | 11/2006 |
| JP | 3870019 | B2 | 1/2007 |
| JP | 3983768 | B2 | 9/2007 |
| JP | 4364045 | B2 | 11/2009 |
| JP | 2010180662 | A | 8/2010 |
| JP | 4589502 | B2 | 12/2010 |
| JP | 4724687 | B2 | 7/2011 |
| JP | 4724777 | B2 | 7/2011 |
| JP | 6796409 | B2 | 12/2020 |

OTHER PUBLICATIONS

Office Action issued in Japanese Patent Application No. 2022-090850, mailed on Jan. 23, 2024 (10 pages).

* cited by examiner

*Primary Examiner* — Patrick J Maestri
(74) *Attorney, Agent, or Firm* — Osha Bergman Watanabe & Burton LLP

(57) ABSTRACT

A foundation packing 1 includes a pair of long packing main bodies 2 and connectors 3. The paired long packing main bodies 2 include a first packing main body 11 and a second packing main body 12. The connectors 3 bridge the paired packing main bodies 2. The connectors 3 are provided at intervals in the longitudinal direction of the paired packing main bodies 2. The first packing main body 11 includes a long top plate 21, a long bottom plate 22, vertical plates 23, and reinforcing shelf boards 24. The top plate 21, the bottom plate 22, and the vertical plates 23 form ventilation passages 30 penetrating the packing main bodies in the width direction of the foundation packing 1. The reinforcing shelf board 24 divides each ventilation passage 30 into two in the up-down direction.

12 Claims, 15 Drawing Sheets

FOUNDATION PACKING

BACKGROUND OF THE INVENTION

This application claims the benefit of Japanese Pat. App. No. 2022-090850 filed on Jun. 3, 2022, which application is incorporated herein by reference in its entirety.

The present invention relates to a foundation packing that is provided on a foundation of a building and is made of synthetic resin.

A construction method of providing a foundation packing between a foundation and a sill plate of a building has recently become popular in order to improve the durability of the building by insulating the foundation from the sill plate and drying the area under the floor by utilizing a natural airflow. As such a foundation packing, the applicant has proposed a foundation packing that is made of synthetic resin and is arranged so that ventilation holes are formed to penetrate an outer side surface and an inner side surface of the foundation packing in a width direction that is orthogonal to the longitudinal direction (one direction) of the foundation packing in order to achieve ventilation between the area under the floor and the outside of the building through the ventilation holes (see Patent Literature 1 (Japanese Patent No. 3848523)). It is noted that the longitudinal direction of the foundation packing is identical with the direction in which the foundation packings are aligned or lined up. Such ventilation holes of the foundation packing are designed to have ventilation areas with which desired ventilation capability is achieved and are formed by dividing walls (vertical plates) that are provided at intervals along the longitudinal direction. Each dividing wall is disposed and designed to have strength sufficient to endure the load of the building above the foundation packing.

The foundation packing of Patent Literature 1 is arranged so that the ventilation holes are formed by the dividing walls aligned between the top plate and the bottom plate. In addition to this, a foundation packing in which the bottom plate is not provided but the compressive strength is maintained by reinforcing each dividing wall by a rod-shaped reinforcement crosspiece has been proposed (see Patent Literature 2 (Japanese Patent No. 3983768)).

SUMMARY OF THE INVENTION

To further improve the ventilation capability of each of the foundation packings of Patent Literature 1 and Patent Literature 2, it is necessary to enlarge the ventilation area by thickening the foundation packing itself. As a result of this, each ventilation hole is further elongated vertically. However, when the ventilation hole is vertically long in shape, the compressive strength of the foundation packing tends to be deteriorated. Furthermore, the dividing walls that stand vertically tend to be less resistant to quake in the horizontal directions. There are demands for a structure that is resistant to significant quake (load) in the horizontal directions, which is so-called horizontal quake and caused by large earthquakes that often occur recently.

An object of the present invention is to provide a foundation packing that is resistant to horizontal quake while suppressing deterioration in compressive strength.

A foundation packing disclosed in this description is mounted on a foundation, is provided between the foundation and a building main body constructed above the foundation, and is made of synthetic resin, the foundation packing comprising: paired long packing main bodies; and connectors which bridge the packing main bodies and are provided between the packing main bodies at intervals in a longitudinal direction of the packing main bodies. Each of the packing main bodies includes: a top plate which is long in the longitudinal direction of the foundation packing; a bottom plate which is long in the longitudinal direction of the foundation packing and is provided below the top plate; vertical plates which are provided between the top plate and the bottom plate to stand up and are at predetermined intervals in a longitudinal direction of the foundation packing; and reinforcing shelf boards which divide ventilation passages into two in an up-down direction, the ventilation passages being formed by the top plate, the bottom plate, and the vertical plates and penetrating each of the packing main bodies in a width direction of the foundation packing. The width direction is orthogonal to the longitudinal direction and the up-down direction of the foundation packing.

It is possible to provide a foundation packing which is resistant to horizontal quake without deterioration in compressive strength.

DESCRIPTION OF THE PREFERRED EMBODIMENTS

First Embodiment

Figure 1:
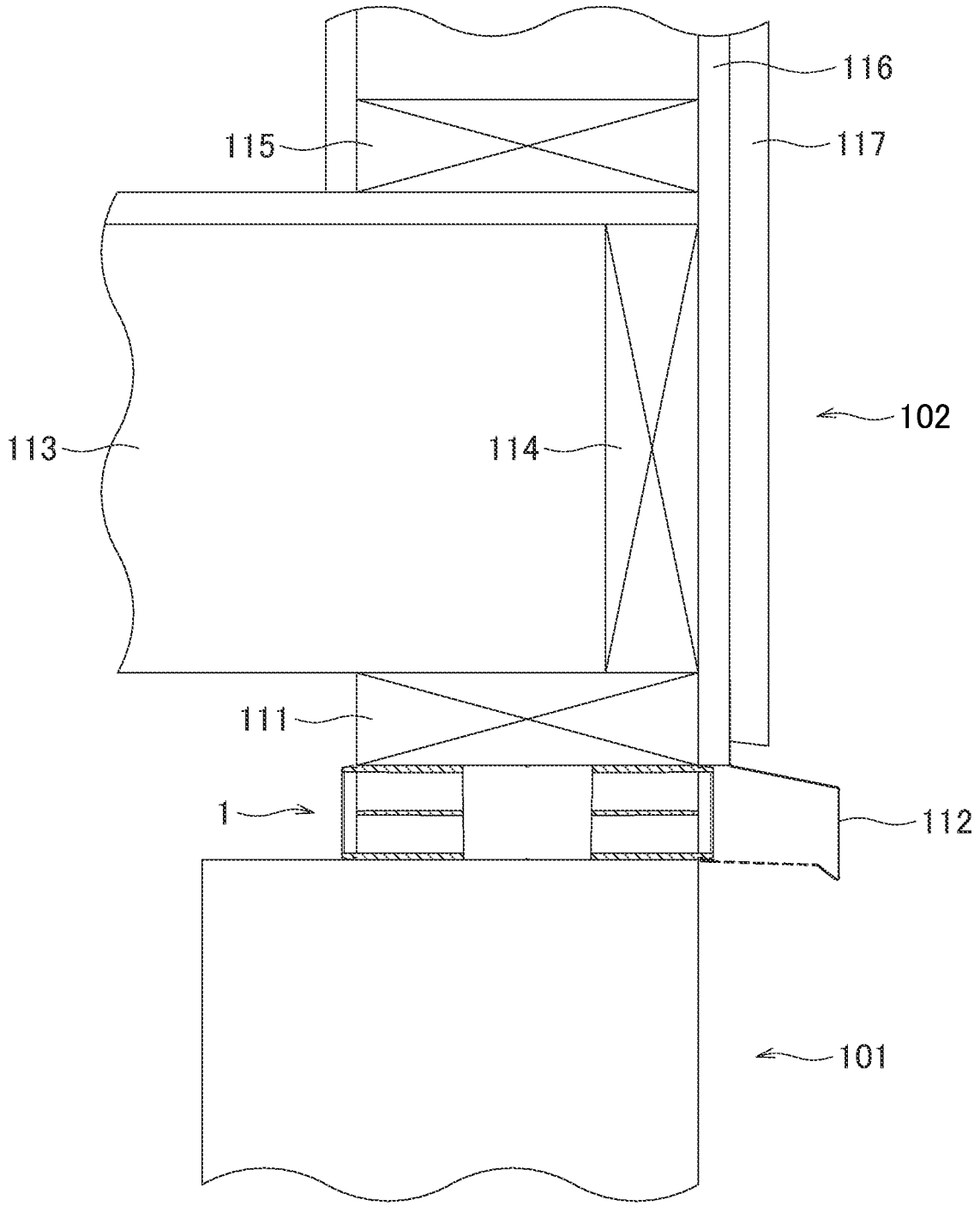
FIG. 1 shows a state in which a foundation packing of First Embodiment is provided between a foundation and a building main body.

A foundation packing 1 of the present embodiment is placed on a foundation on the ground. The foundation packing is a building material which is placed on a concrete foundation wall of a building. The foundation packing 1 is provided between the foundation and a building main body constructed above the foundation. For example, plural foundation packings 1 are continuously provided on an outer peripheral foundation. The foundation packings 1 arranged in this way may be called continuous perimeter foundation vents. FIG. 1 shows a state in which the foundation packing 1 is provided between (i) a foundation 101 and (ii) a building main body 102 that is constructed above the foundation 101 and includes members such as a sill plate 111, an architectural covering 112, a floor joist 113, a rim joist 114, a sole plate 115, an OSB 116, and an exterior wall 117. The foundation packing 1 is made of synthetic resin.

Figure 2:
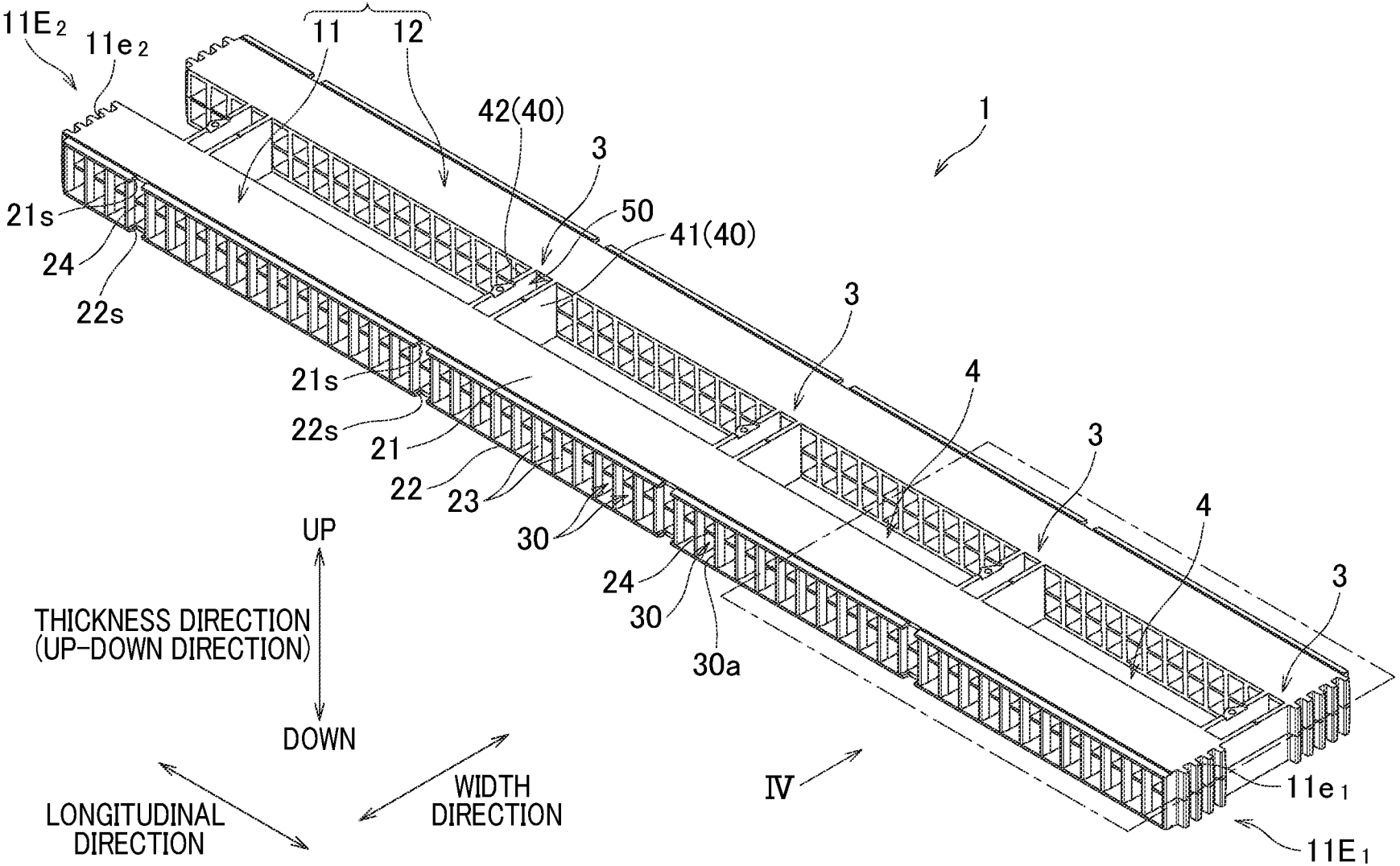
FIG. 2 is a perspective view of the foundation packing of First Embodiment viewed from one side (top surface side).
Figure 3:
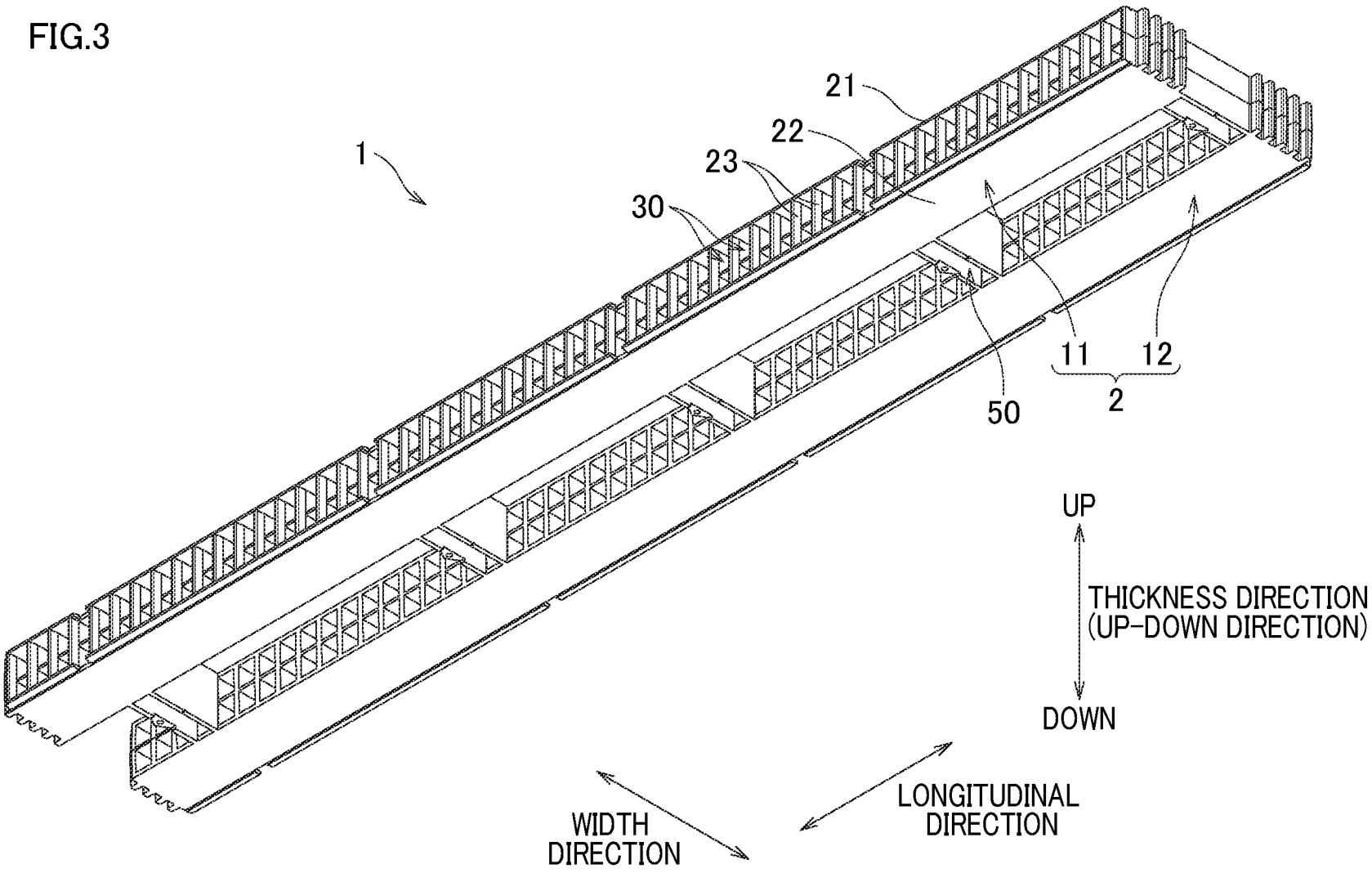
FIG. 3 is a perspective view of the foundation packing of First Embodiment viewed from the other side (bottom surface side).

FIG. 2 is a perspective view of the foundation packing 1 viewed from one side (from the top surface side (upper surface side) in this case). FIG. 3 is a perspective view of the foundation packing 1 viewed from the other side (from the bottom surface side (lower surface side) in this case). As shown in FIG. 2 and FIG. 3, the foundation packing 1 includes a pair of long packing main bodies 2 and connectors 3 that bridge the paired packing main bodies 2.

As shown in FIG. 2, the paired packing main bodies 2 include a long first packing main body 11 (packing main body) and a long second packing main body 12 (packing main body). The first packing main body 11 and the second packing main body 12 are distanced from each other in a width direction of the foundation packing 1. The width direction of the foundation packing 1 is a direction orthogonal to the longitudinal direction and the thickness direction (up-down direction in FIG. 2) of the foundation packing 1. Between the first packing main body 11 and the second packing main body 12, the connectors 3 are provided to be distanced from one another in the longitudinal direction of the foundation packing 1.

In the present embodiment, the first packing main body 11 and the second packing main body 12 are structurally identical. The first packing main body 11 will be explained below, and the explanation of the second packing main body 12 will not be done.

(First Packing Main Body)

The first packing main body 11 includes a long top plate 21, a long bottom plate 22 (see FIG. 3), vertical plates 23 provided between the top plate 21 and the bottom plate 22 and standing up in the up-down direction, and reinforcing shelf boards 24. The top plate 21 and the bottom plate 22 are disposed to be substantially horizontal. The top plate 21 connects the upper ends of the vertical plates 23 with one another. The bottom plate 22 is provided below the top plate 21. The bottom plate 22 connects the lower ends of the vertical plates 23 with one another. The vertical plates 23 are provided at predetermined intervals in the longitudinal direction of the foundation packing 1.

The top plate 21, the bottom plate 22, and the vertical plates 23 form ventilation passages 30 in the first packing main body 11. The ventilation passages 30 are aligned in the longitudinal direction of the foundation packing 1. Each ventilation passage 30 penetrates the first packing main body 11 in the width direction.

Figure 4:
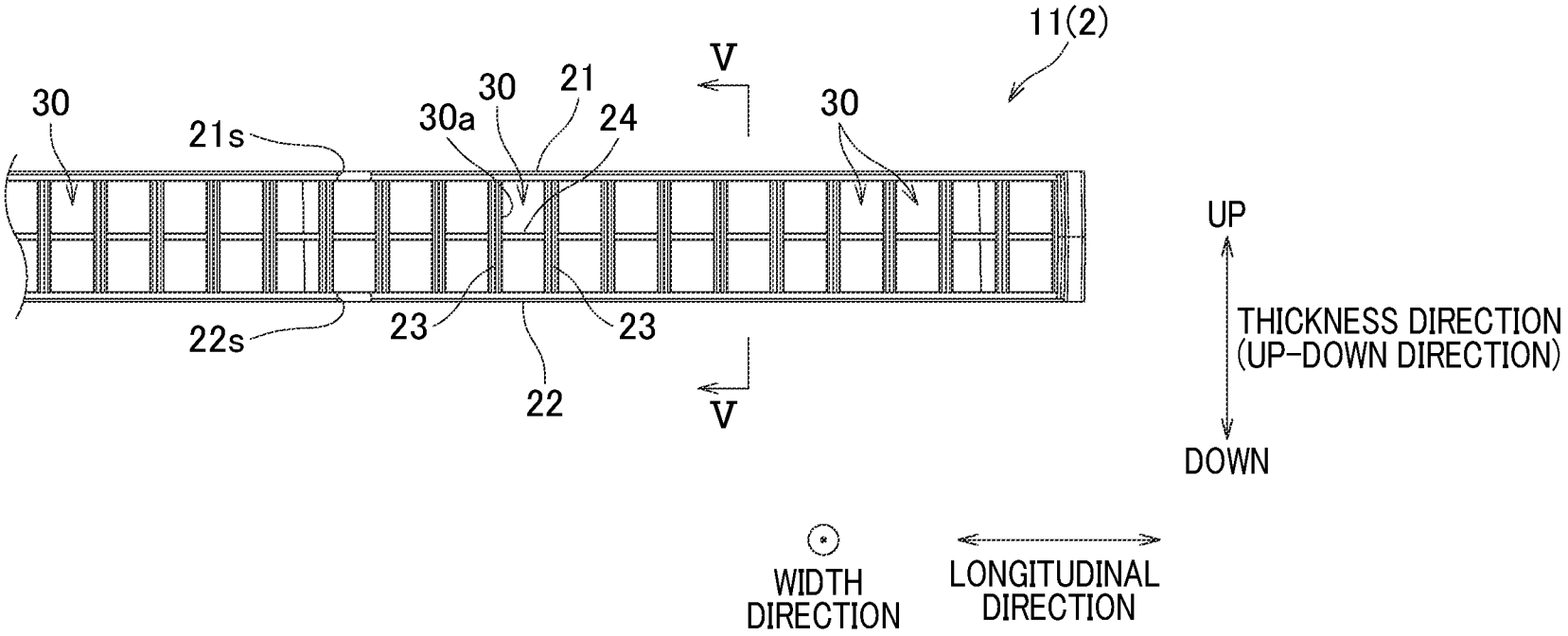
FIG. 4 is a side view of part of the foundation packing of First Embodiment (i.e., a part encircled by a one-dot chain line in FIG. 2 is viewed in a direction IV).

FIG. 4 is a side view of part of the foundation packing 1 (i.e., a part encircled by a one-dot chain line in FIG. 2 is viewed in a direction IV). As shown in FIG. 4, a single ventilation passage 30 is surrounded by the top plate 21, the bottom plate 22, and two neighboring vertical plates 23. An outer opening 30*a* of the ventilation passage 30 is rectangular in shape and is long in the thickness direction (up-down direction). This outer opening 30*a* of the ventilation passage 30 is an opening of the ventilation passage 30, which is on the side opposite to the connector 3 and the second packing main body 12 in the width direction (see FIG. 2), i.e., on the outer side in the width direction as described below (see FIG. 5). A cross section of the ventilation passage 30 cut along the longitudinal direction and the thickness direction (up-down direction) of the first packing main body 11 is identical in shape with the outer opening 30*a* shown in FIG. 4, and is rectangular in shape and long in the thickness direction (up-down direction).

As shown in FIG. 4, the reinforcing shelf boards 24 are provided between the top plate 21 and the bottom plate 22. Each reinforcing shelf board 24 is horizontal and extends in the longitudinal direction and the width direction of the foundation packing 1. Each reinforcing shelf board 24 is substantially in parallel to the top plate 21 and the bottom plate 22. Each reinforcing shelf board 24 is connected to the vertical plates 23 provided on the respective sides. The reinforcing shelf board 24 divides each ventilation passage 30 into two relative to the thickness direction of the foundation packing 1 (i.e., in the up-down direction in FIG. 2, FIG. 3, and FIG. 4). In the present embodiment, the reinforcing shelf board 24 is at the center of the height of the ventilation passage 30. To put it differently, each reinforcing shelf board 24 is provided in the middle between the top plate 21 and the bottom plate 22. Because all reinforcing shelf boards 24 are provided to be identical in height in First Embodiment, the reinforcing shelf boards 24 form a long single plate provided in the middle between the top plate 21 and the bottom plate 22. In the present invention, each reinforcing shelf board 24 may be provided at a location deviated upward or downward from the center of the height of the ventilation passage 30, the reinforcing shelf boards 24 may be formed at different heights in the respective ventilation passages 30, each reinforcing shelf board 24 may be horizontal or slightly tilted in the longitudinal direction and/or the width direction of the foundation packing 1, and each reinforcing shelf board 24 may be identical in length or shorter than the ventilation passage 30 in the width direction. In summary, the reinforcing shelf board 24 is a connecting and reinforcing plate connecting two neighboring vertical plates 23 (in the ventilation passage 30).

As shown in FIG. 2, the reinforcing shelf board 24 is distanced from the outer opening 30*a* of the ventilation passage 30. To be more specific, the reinforcing shelf board 24 is arranged as described below.

Figure 5:
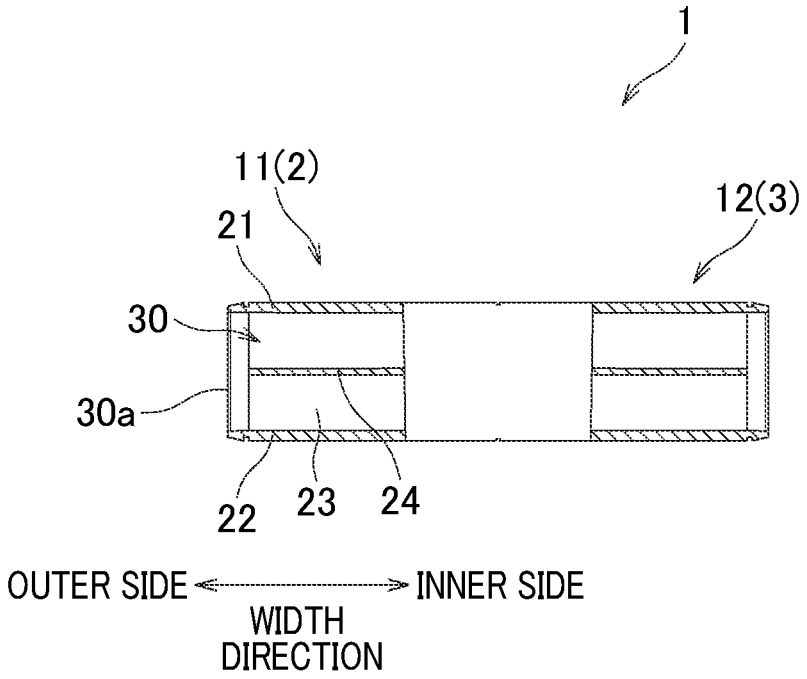
FIG. 5 is a cross section cut along the width direction of the foundation packing of First Embodiment (i.e., a cross section cut along a line V-V in FIG. 4).

FIG. 5 is a cross section cut along the width direction of the foundation packing 1 (i.e., a cross section cut along a line V-V in FIG. 4). In FIG. 5, in the first packing main body 11, relative to the width direction, the side close to the second packing main body 12 is referred to as the inner side in the width direction, whereas the side far from the second packing main body 12 is referred to as the outer side in the width direction. The reinforcing shelf board 24 is positioned on the inner side in the width direction of the outer opening 30*a* of the ventilation passage 30. On the outer side in the width direction of the first packing main body 11, one end of the reinforcing shelf board 24 is on the inner side in the width direction of one end of the top plate 21, one end of the bottom plate 22, and one end of the vertical plate 23. The reinforcing shelf board 24 is formed across the entirety of the first packing main body 11 in the width direction, except at the outer side in the width direction of the first packing main body 11.

As described below, in the top plate 21, a top plate cutout 21*s* is formed at an end portion on the outer side in the width direction (see, e.g., FIG. 2). In the bottom plate 22, a bottom plate cutout 22*s* is formed at an end portion on the outer side in the width direction. Except at portions where the top plate cutout 21*s* and the bottom plate cutout 22*s* are formed, the reinforcing shelf board 24 is provided on the inner side in the width direction of the outer opening of the ventilation passage 30 (see FIG. 5).

(Connector 3)

Figure 6:
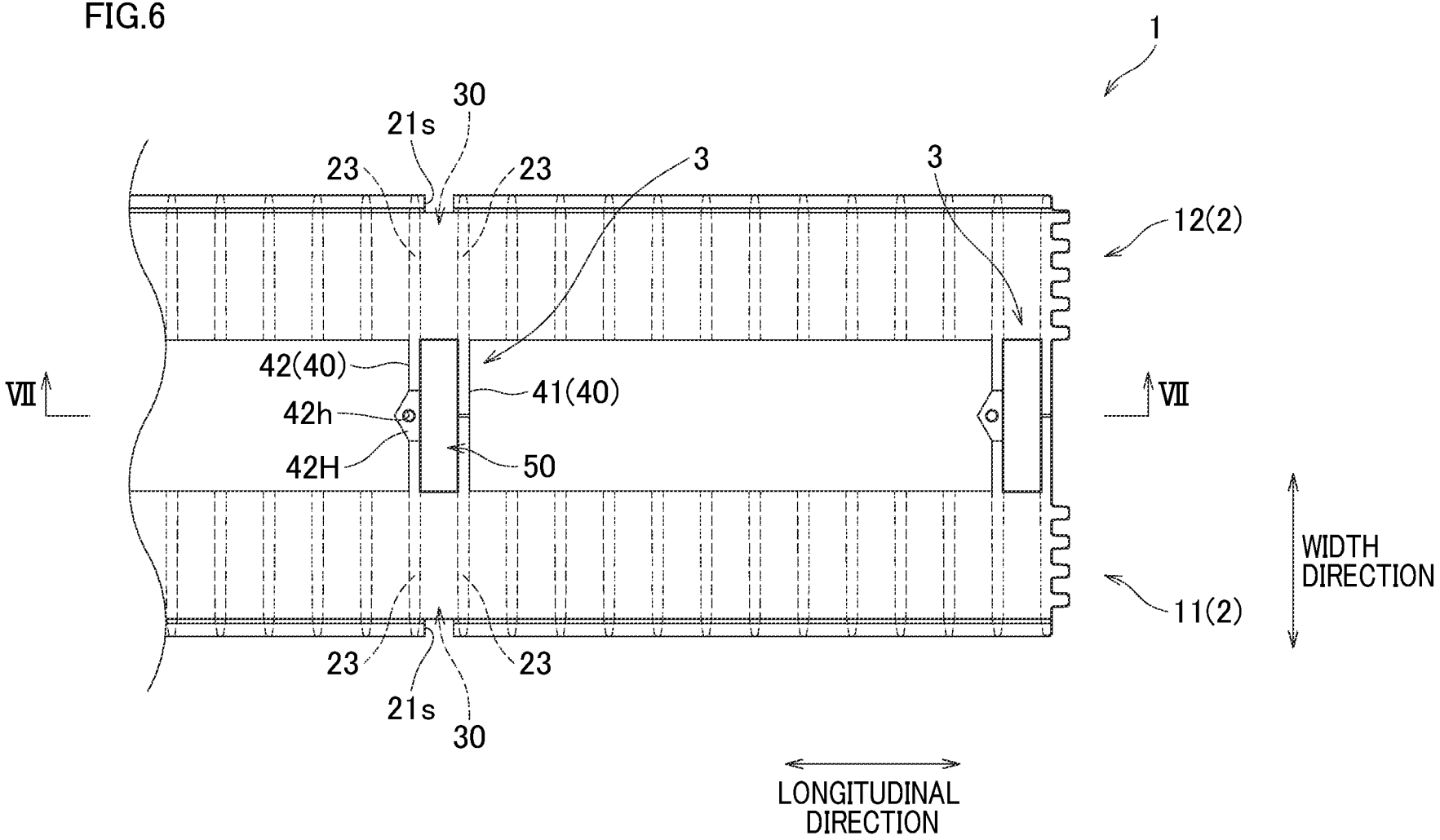
FIG. 6 is a plan view of part of the foundation packing of First Embodiment (i.e., a plan view of the part encircled by a one-dot chain line in FIG. 2).

FIG. 6 is a plan view of part of the foundation packing (i.e., a plan view of a part encircled by a one-dot chain line in FIG. 2). As shown in FIG. 6, the connector 3 has a pair of side plates 40. The paired side plates 40 include a first side plate 41 and a second side plate 42. The first side plate 41 and the second side plate 42 oppose each other in the longitudinal direction of the foundation packing 1. Each of the first side plate 41 and the second side plate 42 extends from the vertical plate 23 of the first packing main body 11 and the vertical plate 23 of the second packing main body 12.

Between the first side plate 41 and the second side plate 42, an intermediate ventilation passage 50 is formed. As shown in FIG. 6, the intermediate ventilation passage 50 is continuous with the ventilation passage 30 formed in the first packing main body 11 and the ventilation passage 30 formed in the second packing main body 12, in the width direction of the foundation packing 1.

The intermediate ventilation passage 50 is open top and open bottom (see FIG. 2 and FIG. 3). A ceiling portion and a bottom portion of the intermediate ventilation passage are not surrounded by the foundation packing 1. The ceiling portion of the intermediate ventilation passage 50 is an upper end portion of the intermediate ventilation passage 50 in the height direction (up-down direction) (see FIG. 2). The bottom portion of the intermediate ventilation passage 50 is a lower end portion of the intermediate ventilation passage 50 in the height direction (up-down direction) (see FIG. 3).

Figure 7:
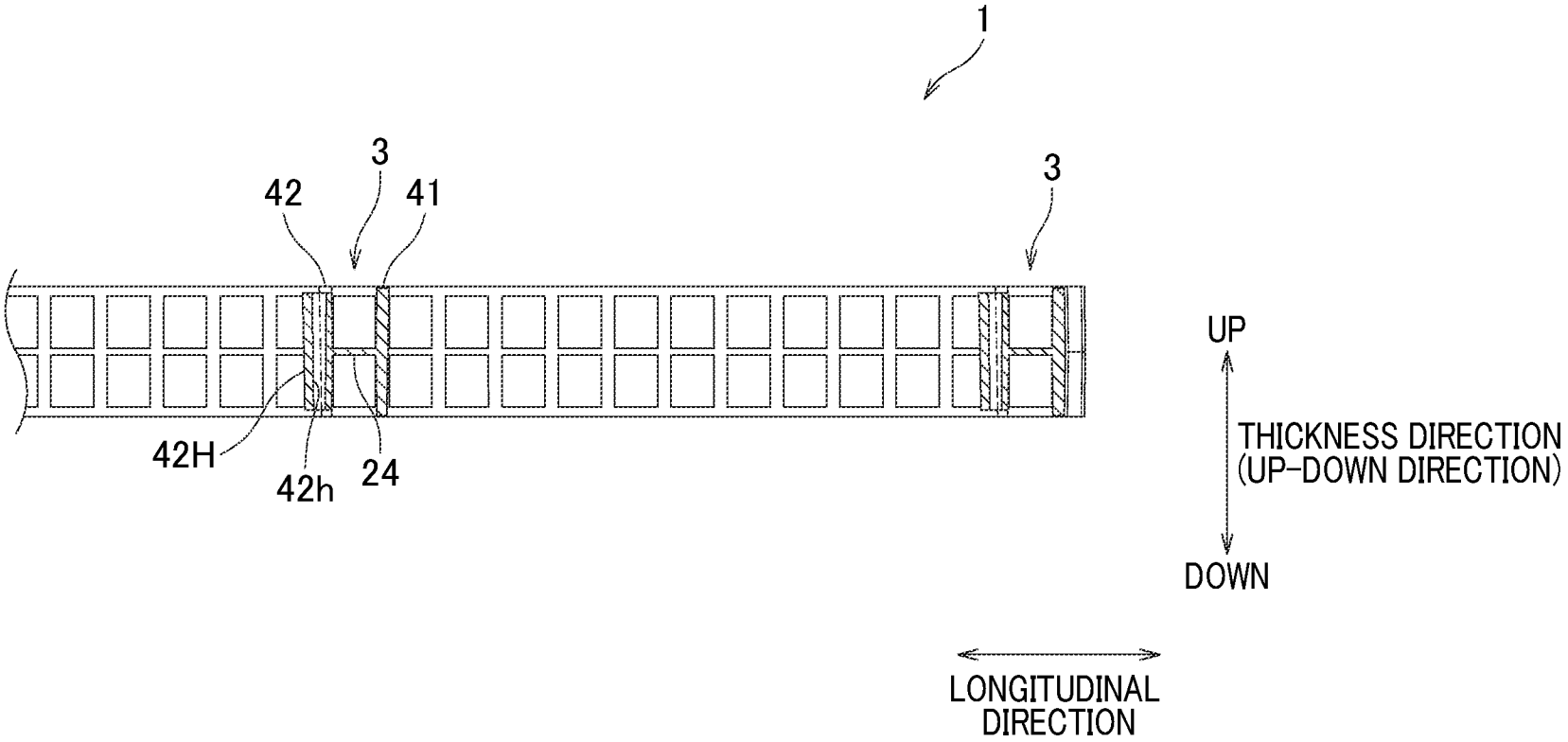
FIG. 7 is a partial cross section cut along the longitudinal direction of the foundation packing of First Embodiment (i.e., a cross section cut along a line VII-VII in FIG. 6).

FIG. 7 is a cross section cut along a line VII-VII shown in FIG. 6. As shown in FIG. 7, each connector 3 is provided with a reinforcing shelf board 24. This reinforcing shelf board 24 is connected to the first side plate 41 and the second side plate 42. The reinforcing shelf board 24 extends from the reinforcing shelf board 24 (see FIG. 2) of the first packing main body 11 and the reinforcing shelf board 24 of the second packing main body 12. The reinforcing shelf board 24 is formed across the entirety of the connector 3 in the width direction.

As shown in FIG. 6, a protrusion 42H is formed at around the center of the second side plate 42. The protrusion 42H protrudes in the longitudinal direction of the foundation packing 1. The protrusion 42H is formed in such a way that the sharpest part (apex) of the protrusion 42H is at the center in the width direction of the foundation packing 1.

The protrusion 42H is used for alignment between the foundation 101 and the foundation packing 1. For example, a linear mark (e.g., a marking line) may be depicted to extend in the longitudinal direction of the foundation 101, at around the center in the width direction of the top surface of the foundation 101 shown in FIG. 1. In this case, the alignment between the foundation packing 1 and the foundation 101 can be done by mounting the foundation packing 1 on the foundation 101 so that the apex of the protrusion 42H shown in FIG. 6 is on the mark.

As shown in FIG. 6, the protrusion 42H has a hole 42*h*. The hole 42*h* penetrates the second side plate 42 in the thickness direction (up-down direction) (see FIG. 7). The hole 42*h* is penetrated by a nail, etc. For example, the foundation packing 1 can be fixed to the foundation 101 shown in FIG. 1 by mounting the foundation packing 1 on the foundation 101 and inserting a nail into the hole 42*h* (see FIG. 6 and FIG. 7).

As shown in FIG. 2, in the foundation packing 1, an anchor bolt hole 4 is formed between the connectors 3. Plural anchor bolt holes 4 are formed at intervals in the longitudinal direction of the foundation packing 1. Each anchor bolt hole 4 is a long hole that is long in the longitudinal direction of the foundation packing 1. Anchor bolts are used for joining the foundation 101 with the building main body 102 shown in FIG. 1. An anchor bolt is inserted into each anchor bolt hole 4. Because the anchor bolt hole 4 is a long hole, the degree of freedom in position of the anchor bolt is high.

The length, width, and thickness of the foundation packing 1 are not particularly limited. In First Embodiment, the length is about 920 mm, the width is about 150 mm, and the thickness is about 40 mm. The length in the longitudinal direction of the foundation packing 1 may be suitably determined in consideration of, for example, a manufacturing apparatus, a manufacturing method, shipping, delivery, and handling, and the length may be, for example, 920 mm or more or less than 920 mm. The width of the foundation packing 1 may be suitably determined in accordance with, for example, the width of the foundation 101 on which the foundation packing 1 is mounted, the sill plate mounted on the foundation packing 1, and the sizes of members such as the OSB and the floor joist, and the width preferably falls within a standard range of about 90 to 210 mm. The thickness of the foundation packing 1 is preferably about 20 mm or more, for the purpose of improving the ventilation capability. The size (see, e.g., FIG. 2 and FIG. 4) of the outer opening 30*a* of the ventilation passage 30 formed in the foundation packing 1 is not particularly limited. In First Embodiment, for example, the outer opening 30*a* is rectangular in shape and vertically long, and the length of the opening is about 33 mm and the width of the opening is about 13 mm. The length (height) of the outer opening 30*a* may be 33 mm or more, or may be less than 33 mm. The width of the outer opening 30*a* may be 13 mm or more, or may be less than 13 mm. In First Embodiment, the reinforcing shelf board 24 is distanced by about 6 mm from the outer opening 30*a* of the ventilation passage 30. The distance between the reinforcing shelf board 24 and the outer opening 30*a* is suitably determined on condition that the reinforcement of the vertical plate 23 is achieved. The distance is preferably within a range of about 0 to 10 mm. In First Embodiment, the thickness of each of the top plate 21 and the bottom plate 22 is about 3 mm, the thickness of the vertical plate 23 is about 4 mm, and the thickness of the reinforcing shelf board 24 is about 2 mm. The thickness of each member is not particularly limited, and may be suitably determined in consideration of, for example, the required strength of the foundation packing 1. The size of the opening of the anchor bolt hole 4 is not particularly limited and may be suitably determined. For example, the opening may be about 180 mm in length and about 52 mm in width.

The arrangement above makes it possible to achieve the effects described below.

In the first packing main body 11 of the foundation packing 1, as shown in FIG. 2, the reinforcing shelf boards 24 are provided between the top plate 21 and the bottom plate 22 to divide the ventilation passages 30 into two in the height direction (up-down direction). With the reinforcing shelf boards 24, the foundation packing 1 is resistant to horizontal quake while deterioration in compressive strength of the foundation packing 1 is suppressed.

As the thickness of the foundation packing 1 is increased, the ventilation capability is improved because the cross-sectional area of each ventilation passage 30 (i.e., the cross-sectional area of the ventilation passage along the longitudinal direction and the thickness direction of the foundation packing 1 (equivalent to the area of the outer opening 30*a* of the ventilation passage is enlarged. However, when the thickness of the foundation packing 1 is increased, the compressive strength tends to be deteriorated and the resistance to horizontal quake tends to be lowered. According to the present embodiment, because the reinforcing shelf boards 24 are provided, the foundation packing 1 is resistant to horizontal quake and has improved ventilation capability, while deterioration in compressive strength is avoided, even if the thickness of the foundation packing 1 is increased.

Figure 8:
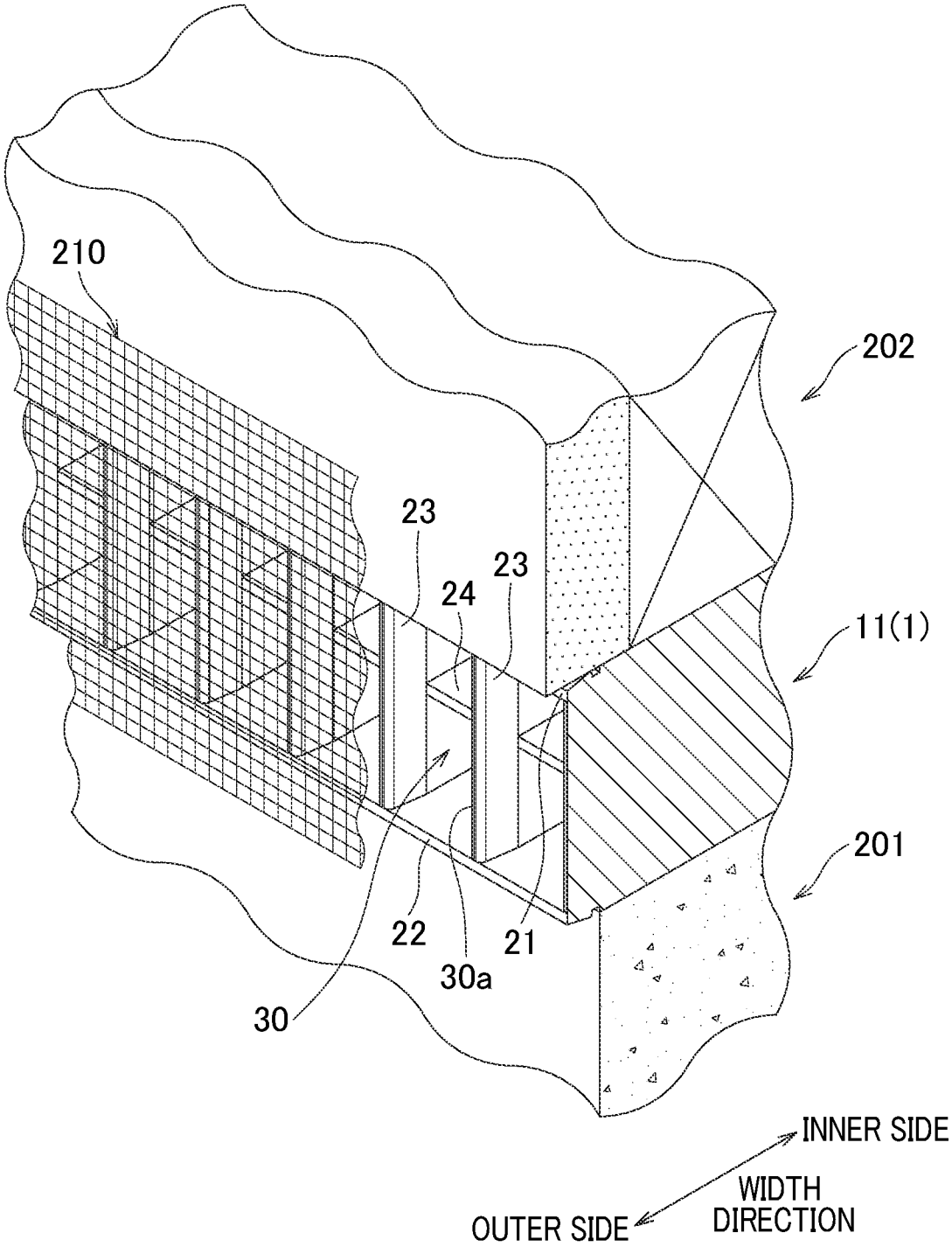
FIG. 8 shows a state in which a net is attached in a state in which the foundation packing of First Embodiment is provided between a foundation and a building main body.

FIG. 8 shows a state in which the foundation packing 1 is provided between a foundation 201 and a building main body 202. In order to avoid entrance of insects and small animals from the outside of the building through the ventilation passages 30 of the foundation packing 1, a member such as a net 210 may be provided to cover the outer openings 30*a* of the foundation packing 1. As shown in FIG. 8, when the net 210 is provided on the outer side in the width direction of the first packing main body 11 of the foundation packing 1, the net 210 is not in contact with the reinforcing shelf boards 24 because each reinforcing shelf board 24 is provided on the inner side in the width direction of the outer opening 30*a*. It is therefore possible to suppress deterioration in the ventilation capability due to the ventilation passages 30. Furthermore, the reinforcing shelf board 24 is positioned to divide the ventilation passage 30 into two in the thickness direction but is not at the outer opening 30*a* of the ventilation passage 30. On this account, the reinforcing shelf board 24 looks to be slightly behind the net 210. This creates a design where vertically-long ventilation passages 30 exist behind the net 210. Furthermore, the foundation packing 1 looks as if it has depth.

As the thickness of the foundation packing 1 is increased, as shown in FIG. 4, the vertical length of a cross section of the ventilation passage 30 (i.e., a cross section along the longitudinal direction and the thickness direction (up-down direction) of the foundation packing 1, which is identical in shape with the outer opening 30*a* of the ventilation passage 30) is increased, with the result that the ventilation capability is improved. In addition to this, the reinforcing shelf board 24 is at the center of the height of the ventilation passage 30. This makes it possible to provide the foundation packing 1 which is sufficiently resistant to horizontal quake and has further improved ventilation capability, while deterioration in strength of the foundation packing 1 is reliably avoided.

Each connector 3 has the intermediate ventilation passage 50 (see FIG. 6). The intermediate ventilation passage 50 is continuous with the ventilation passage 30 formed in the first packing main body 11 and the ventilation passage 30 formed in the second packing main body 12, in the width direction of the foundation packing 1. On this account, the ventilation capability of the foundation packing 1 is high even through the connectors 3 are provided between the first packing main body 11 and the second packing main body 12.

Each connector 3 is provided with a reinforcing shelf board 24 (see FIG. 7). This reinforcing shelf board 24 extends from the reinforcing shelf board 24 (see FIG. 2) of the first packing main body 11 and the reinforcing shelf board 24 of the second packing main body 12. Because the connector 3 is provided with the reinforcing shelf board 24, the deterioration in strength of the foundation packing 1 is further suppressed and the resistance to horizontal quake is enhanced.

As shown in FIG. 2 and FIG. 3, each connector 3 does not have a top plate and a bottom plate. The intermediate ventilation passage 50 of each connector 3 is open top and open bottom. On this account, when the foundation packing 1 is cut along the width direction to obtain the foundation packing 1 with a desired length, the foundation packing 1 can be easily cut even when a connector 3 exists at the cutting position. Furthermore, for example, the foundation packing 1 can be manufactured by injection molding of synthetic resin. In this connection, because the connector 3 does not have a top plate and a bottom plate, the molding of the intermediate ventilation passage 50 can be done by using an upper mold and a lower mold, and some of the teeth of side molds for forming the ventilation passages 30 are not required to mold the intermediate ventilation passages 50. On this account, the teeth facing the intermediate ventilation passages 50 can be shortened, damage to the teeth can be avoided, and the strength of the molds can be improved. Furthermore, because the teeth are short, the degree of sliding the side molds when the molded article is taken off from the molds is decreased. Due to this, the molding cycle is shortened and hence the productivity is improved.

As shown in FIG. 2, in the first packing main body 11, top plate cutouts 21*s* are formed at the end portion on the outer side in the width direction of the top plate 21 (i.e., on the side opposite to the connectors 3 and the second packing main body 12 in the width direction of the foundation packing 1). Bottom plate cutouts 22*s* are formed at the end portion on the outer side in the width direction of the bottom plate 22 (i.e., on the side opposite to the connectors 3 and the second packing main body 12 in the width direction of the foundation packing 1). Because the reinforcing shelf board 24 is provided on the inner side in the width direction of the outer opening 30*a* of the ventilation passage 30, no reinforcing shelf board 24 is provided at a position where the top plate cutout 21*s* overlaps the bottom plate cutout 22*s* in the thickness direction (up-down direction) of the foundation packing 1.

The arrangement above makes it possible to achieve the effects described below.

For example, a linear mark (e.g., a marking line) may be depicted to extend in the longitudinal direction of the foundation 101, at an end portion in the width direction of the top surface of the foundation 101 shown in FIG. 1. In this case, the foundation packing 1 is mounted on the foundation 101 so that the end portion in the width direction of the foundation packing 1 extends along the mark. When the foundation packing 1 is viewed from above, it is possible to check whether there is a mark seen through the top plate cutouts 21*s*. When no mark exists or the direction of the mark is deviated, the foundation 101 is aligned with the foundation packing 1 by adjusting the position of the foundation packing 1.

As shown in, for example, FIG. 2, the top plate cutout 21*s* and the bottom plate cutout 22*s* are positioned to overlap the connector 3 in the width direction of the foundation packing 1. At the position where the connector 3, the top plate cutout 21*s*, and the bottom plate cutout 22*s* are overlapped in the width direction of the foundation packing 1, The foundation packing 1 can be easily cut along the width direction due to the presence of the intermediate ventilation passage 50.

Effects similar to the above are obtained by the second packing main body 12 because it is structurally similar to the first packing main body 11.

As shown in FIG. 2, an engagement portion 11E1 is formed at one end portion in the longitudinal direction of the first packing main body 11. The engagement portion 11E1 has plural protrusions 11*e*1 that protrude in the longitudinal direction of the foundation packing 1. The protrusions 11*e*1 are separated from one another in the width direction of the foundation packing 1.

At the other end portion in the longitudinal direction of the first packing main body 11, an engagement target portion 11E2 is formed. The engagement target portion 11E2 has plural groove portions 11*e*2 that are recessed in the longitudinal direction of the foundation packing 1. The groove portions 11*e*2 are separated from one another in the width direction of the foundation packing 1 and are formed so that protrusions 11*e*1 formed at the one end portion of another foundation packing 1 can be engaged therewith.

One end portion and the other end portion in the longitudinal direction of the second packing main body 12 are arranged to be similar to the one end portion and the other end portion in the longitudinal direction of the first packing main body 11.

With this arrangement, when plural foundation packings 1 are aligned in the longitudinal direction, two neighboring foundation packings 1 are joined by causing the engagement portion 11E1 of one foundation packing 1 to be engaged with the engagement target portion 11E2 of the neighboring foundation packing 1. It is therefore possible to mount the foundation packings 1 on the foundation 101 shown in FIG. 1 to be continuous in the longitudinal direction of the foundation 101.

Second Embodiment

Figure 9:
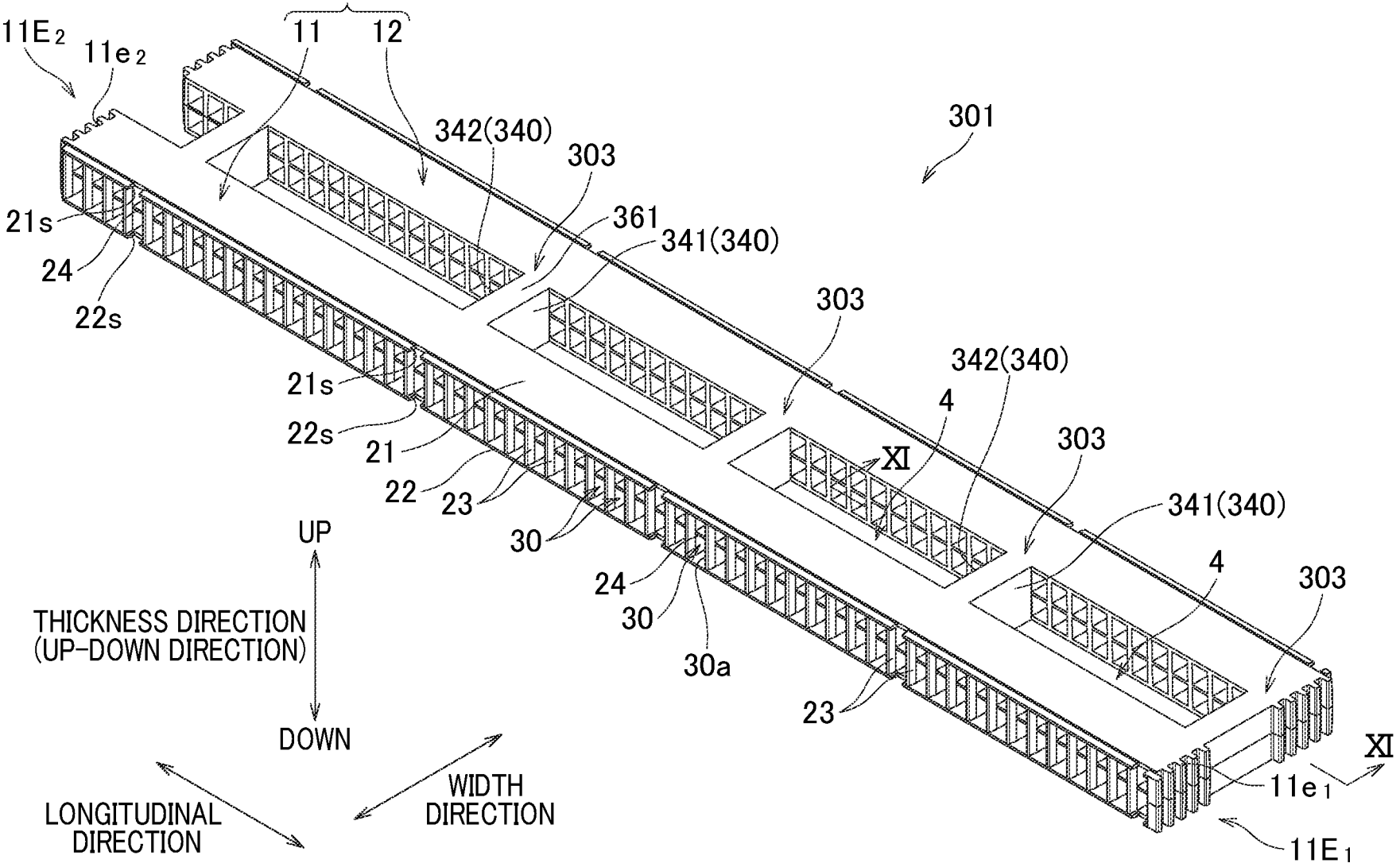
FIG. 9 is a perspective view of the foundation packing of Second Embodiment viewed from one side (top surface side).
Figure 10:
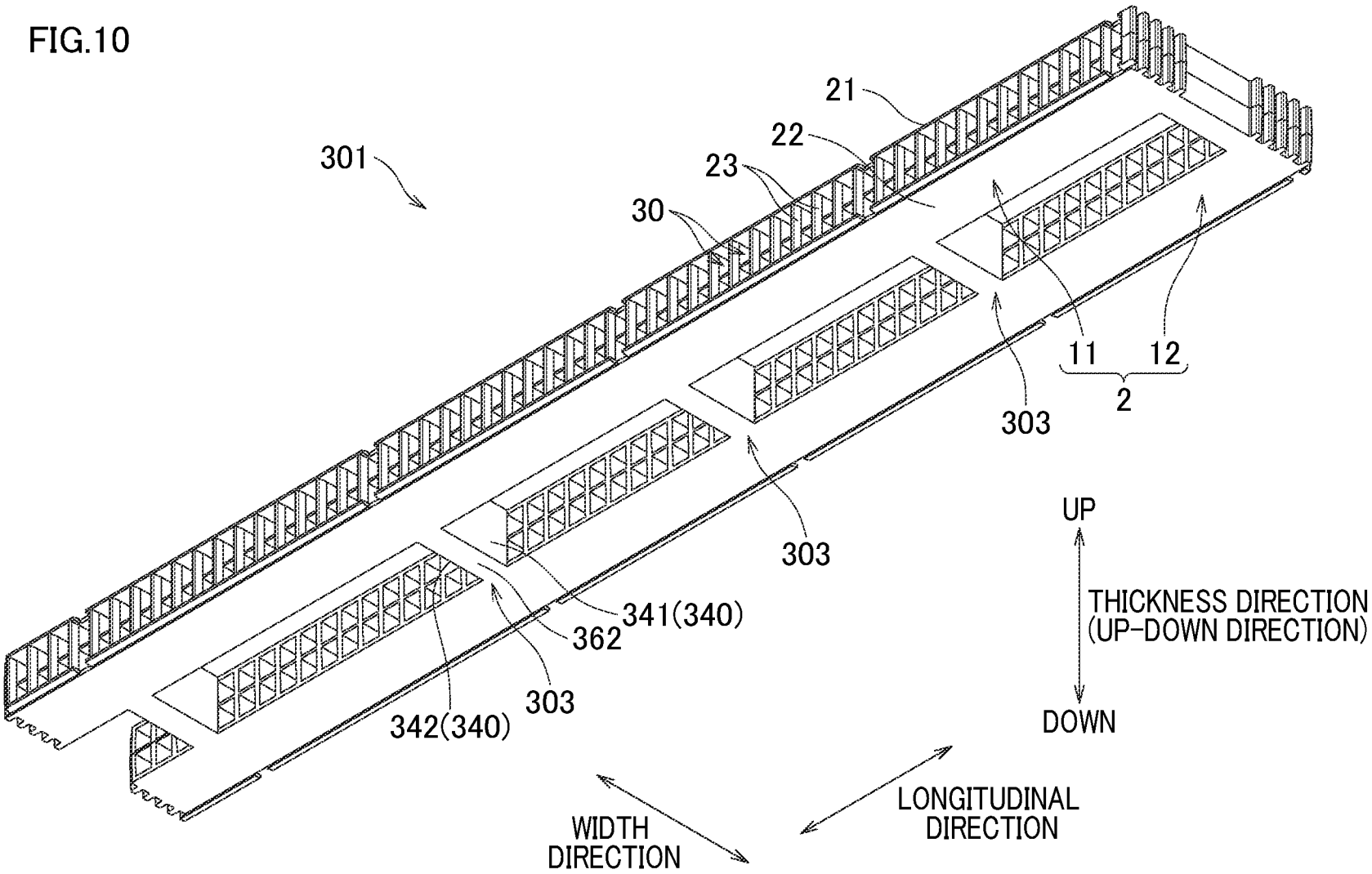
FIG. 10 is a perspective view of the foundation packing of Second Embodiment viewed from the other side (bottom surface side).
Figure 11:
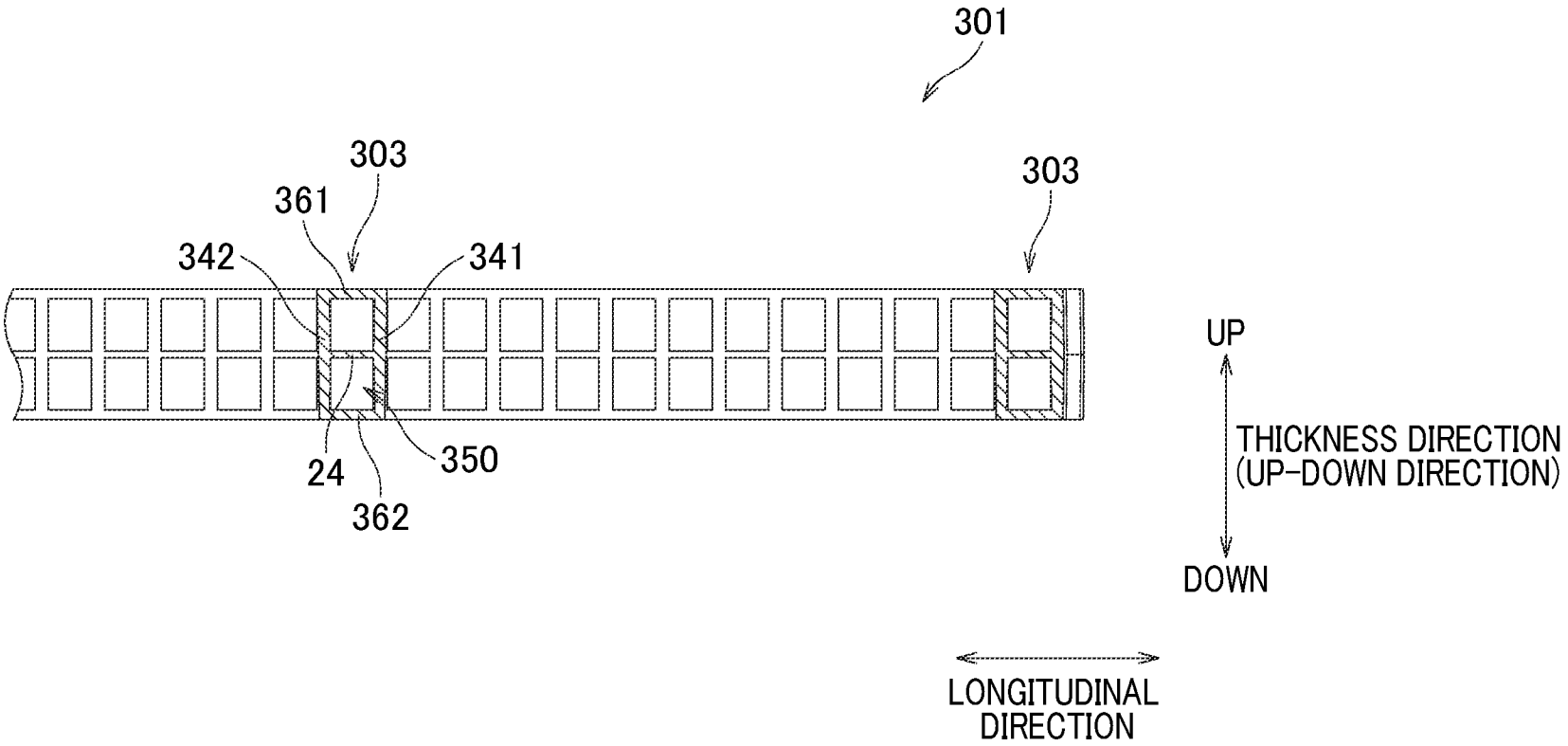
FIG. 11 is a partial cross section cut along the longitudinal direction of the foundation packing of Second Embodiment (i.e., a cross section cut along a line XI-XI in FIG. 9).

The following will describe a foundation packing 301 of Second Embodiment with reference to FIG. 9 to FIG. 11. Second Embodiment is different from First Embodiment in the structure of a connector 303. Members substantially identical with those in First Embodiment above will be denoted by the same reference numerals, and the explanations thereof are omitted as appropriate.

As shown in FIG. 9, a connector 303 of the foundation packing 301 includes a top plate 361, a bottom plate 362 (see FIG. 10), a first side plate 341, and a second side plate 342. As shown in FIG. 9, the top plate 361 extends from the top plate 21 of the first packing main body 11 and the top plate 21 of the second packing main body 12. The bottom plate 362 (see FIG. 10) extends from the bottom plate 22 of the first packing main body 11 and the bottom plate 22 of the second packing main body 12. The first side plate 341 and the second side plate 342 oppose each other in the longitudinal direction of the foundation packing 301. The first side plate 341 and the second side plate 342 constitute a pair of side plates 340. Each of the first side plate 341 and the second side plate 342 extends from the vertical plate 23 of the first packing main body 11 and the vertical plate 23 of the second packing main body 12 (see FIG. 9).

FIG. 11 is a cross section cut along a line XI-XI shown in FIG. 9. Each connector 303 has an intermediate ventilation passage 350 (see FIG. 11). The intermediate ventilation passage 350 is surrounded by the top plate 361, the bottom plate 362, the first side plate 341, and the second side plate 342. The intermediate ventilation passage 350 is continuous with the ventilation passage 30 (see FIG. 9) formed in the first packing main body 11 and the ventilation passage 30 formed in the second packing main body 12, in the width direction of the foundation packing 1.

As shown in FIG. 11, each connector 303 is provided with a reinforcing shelf board 24. This reinforcing shelf board 24 is connected to the first side plate 341 and the second side plate 342. The reinforcing shelf board 24 extends from the reinforcing shelf board 24 (see FIG. 2) of the first packing main body 11 and the reinforcing shelf board 24 of the second packing main body 12. The reinforcing shelf board 24 is formed across the entirety of the connector 303 in the width direction.

As shown in FIG. 9, the connector 303 is positioned to oppose the top plate cutout 21*s* and the bottom plate cutout 22*s* of the first packing main body 11 and the top plate cutout and the bottom plate cutout of the second packing main body 12, in the width direction of the foundation packing 1. As shown in FIG. 9, the connector 303 is positioned to overlap the top plate cutout 21*s* and the bottom plate cutout 22*s* of the first packing main body 11 and the top plate cutout and the bottom plate cutout of the second packing main body 12, in the width direction of the foundation packing 1.

With the foundation packing 301 of Second Embodiment, effects similar to those of First Embodiment are obtained and the strength is improved because the top plate 361 and the bottom plate 362 are provided for the connector 303.

Thus, the embodiments of the present invention are described hereinabove based on examples. However, the specific structure of the present invention shall not be interpreted as to be limited to the above described embodiments. The scope of the present invention is defined not by the above embodiments but by claims set forth below, and shall encompass the equivalents in the meaning of the claims and every modification within the scope of the claims.

Figure 12:
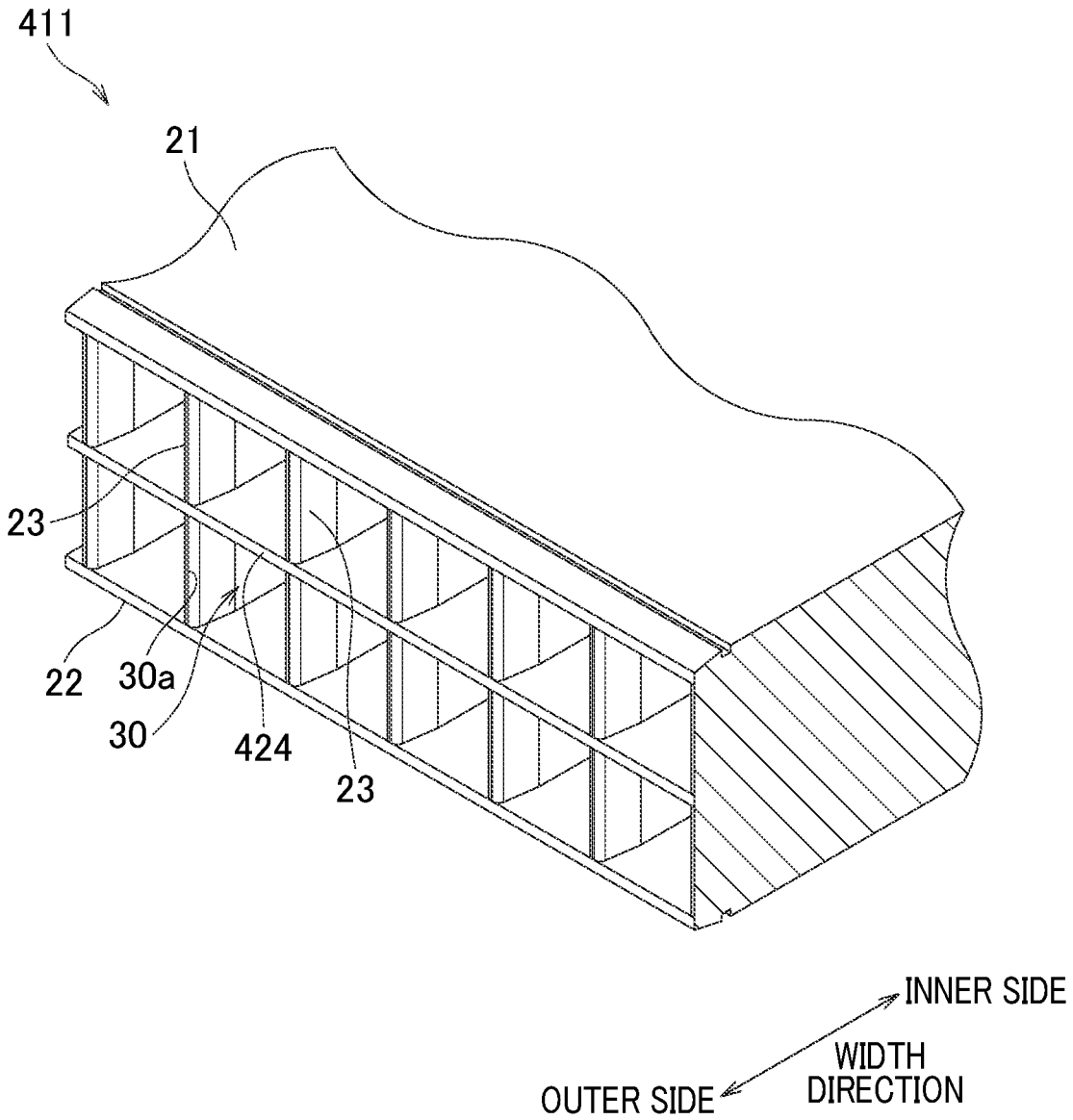
FIG. 12 is a partial perspective view of a foundation packing of a modification.

For example, in First Embodiment, the reinforcing shelf board 24 is distanced from the outer opening 30*a* of the ventilation passage 30 as shown in FIG. 2, etc. To be more specific, the reinforcing shelf board 24 is positioned on the inner side in the width direction of the outer opening of the ventilation passage 30 (see, e.g., FIG. 5 and FIG. 8). In this connection, the reinforcing shelf board 24 may not be separated from the outer opening 30*a* of the ventilation passage 30. For example, as shown in FIG. 12, a reinforcing shelf board 424 may exist at the outer opening of the ventilation passage 30 in a first packing main body 411. On the outer side in the width direction of the first packing main body 411 shown in FIG. 12, one end of the reinforcing shelf board 424 is substantially on the same plane as one end of the top plate 21, one end of the bottom plate 22, and one end of the vertical plate 23.

The second packing main body 12 may be changed in a similar manner.

A similar change may be done in Second Embodiment and modifications shown in FIG. 12 and subsequent figures, too.

In First Embodiment described above, as shown in FIG. 2, etc., the ventilation passage 30 formed in the foundation packing 1 has a vertically-long rectangular shape and is long in thickness direction of the foundation packing 1 (i.e., the up-down direction in FIG. 2 and FIG. 3). The ventilation passage, however, may not be vertically long. The ventilation passage may not be rectangular in shape. The shape of the ventilation passage is changeable.

A similar change of the shape of the ventilation passage 30 may be done in Second Embodiment and modifications shown in FIG. 12 and subsequent figures, too.

The reinforcing shelf board 24 shown in, for example, FIG. 4 of First Embodiment described above is changeable as described below.

For example, in First Embodiment described above, the reinforcing shelf board 24 is at the center of the height of the ventilation passage 30 as shown in FIG. 4, etc. Alternatively, the reinforcing shelf board 24 may be deviated upward or downward from the center of the height of the ventilation passage 30.

In First Embodiment described above, the reinforcing shelf boards 24 are at the same height (at the center of the height of each ventilation passage 30) in all ventilation passages 30 as shown in FIG. 4, etc. Alternatively, the reinforcing shelf boards 24 may be at different heights in the respective ventilation passages 30.

In First Embodiment described above, the reinforcing shelf board 24 is horizontal as shown in FIG. 4, etc. The reinforcing shelf board 24, however, may not be horizontal. The reinforcing shelf board 24 may be slightly tilted relative to the longitudinal direction and/or the width direction of the foundation packing 1.

In First Embodiment above, as shown in, for example, FIG. 2, FIG. 3, and FIG. 5, the reinforcing shelf board 24 may extend across the entire ventilation passage 300 in the width direction or may be provided only at part of the ventilation passage 300 in the width direction, in the first packing main body 11 and the second packing main body 12.

A similar change of the position of the reinforcing shelf board 24 may be done in Second Embodiment and modifications shown in FIG. 12 and subsequent figures, too.

In First Embodiment above, as shown in FIG. 7, each connector 3 is provided with a reinforcing shelf board 24. This reinforcing shelf board 24 of the connector 3 extends from the reinforcing shelf board 24 (see FIG. 2) of the first packing main body 11 and the reinforcing shelf board 24 of the second packing main body 12. In this connection, the connector 3 may not be provided with the reinforcing shelf board 24. When the connector 3 is provided with the reinforcing shelf board 24, the reinforcing shelf board 24 of the connector 3 may not be extended from the reinforcing shelf board 24 of the first packing main body 11 and/or the reinforcing shelf board 24 of the second packing main body 12.

A similar change may be done in Second Embodiment and modifications shown in FIG. 12 and subsequent figures, too.

In First Embodiment above, as shown in FIG. 6, the connector 3 is arranged so that each of the first side plate 41 and the second side plate 42 extends from the vertical plate 23 of the first packing main body 11 and the vertical plate 23 of the second packing main body 12. In this regard, the first side plate 41 and/or the second side plate 42 may not extend from the vertical plate 23 of the first packing main body 11 and the vertical plate 23 of the second packing main body 12.

A similar change may be done in Second Embodiment and modifications shown in FIG. 12 and subsequent figures, too.

In First Embodiment above, the connector 3 is entirely open top and entirely open bottom as shown in FIG. 2 and FIG. 3. Alternatively, the connector 3 may be open either top or bottom, or may be partially open at a ceiling portion and/or a bottom portion.

In Second Embodiment above, as shown in FIG. 9 and FIG. 10, the connector 303 has the top plate 361 and the bottom plate 362, and the connector 303 is entirely closed at its ceiling portion and bottom portion. Alternatively, in Second Embodiment, the connector 303 may not have either the top plate 361 or the bottom plate 362, and the connector 303 may be partially open at the ceiling portion and/or the bottom portion.

Figure 13:
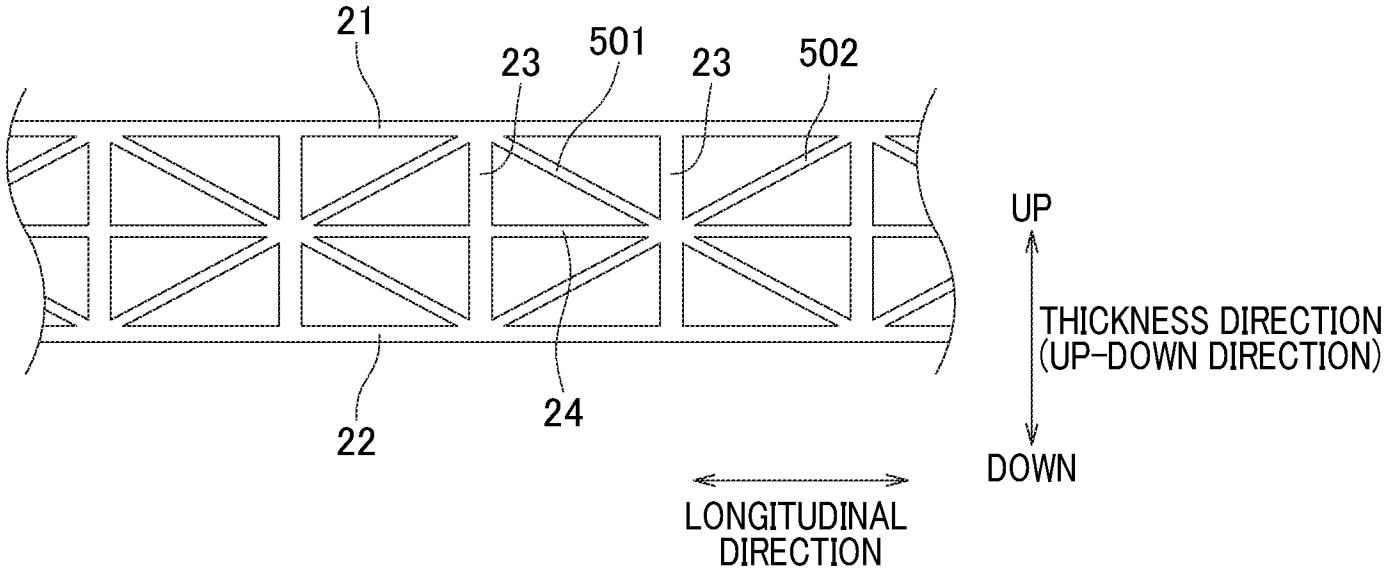
FIG. 13 is a partial cross section cut along the longitudinal direction of a first packing main body of a foundation packing of another modification.
Figure 14:
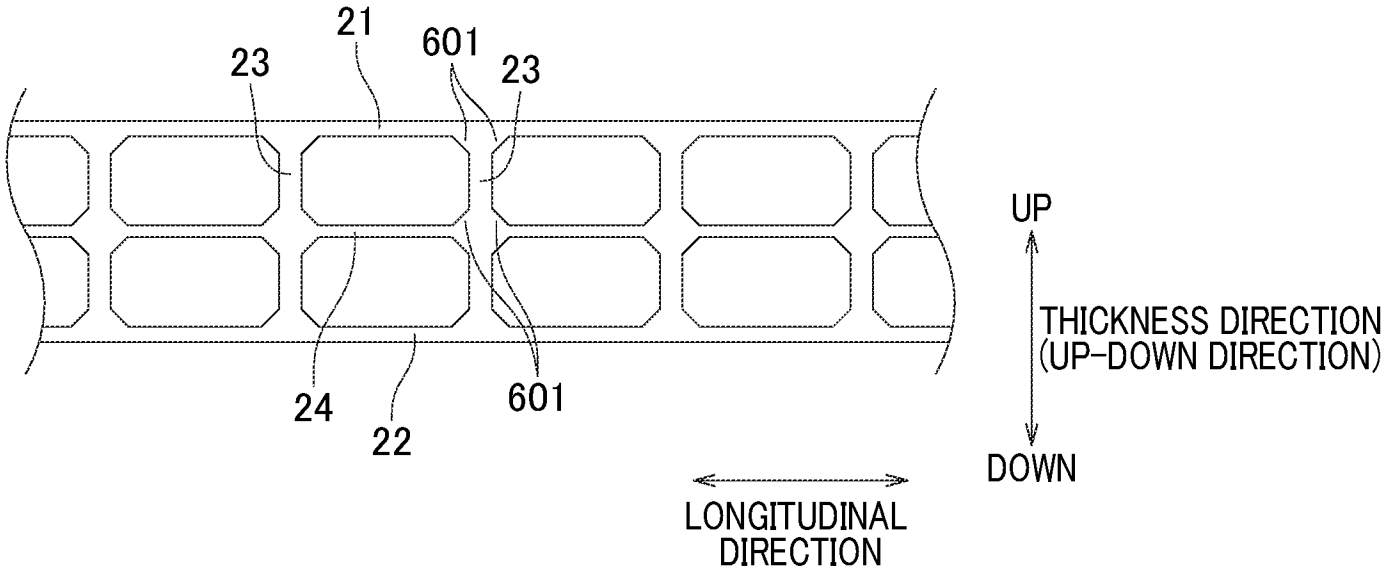
FIG. 14 is a partial cross section cut along the longitudinal direction of a first packing main body of a foundation packing of another modification.
Figure 15:
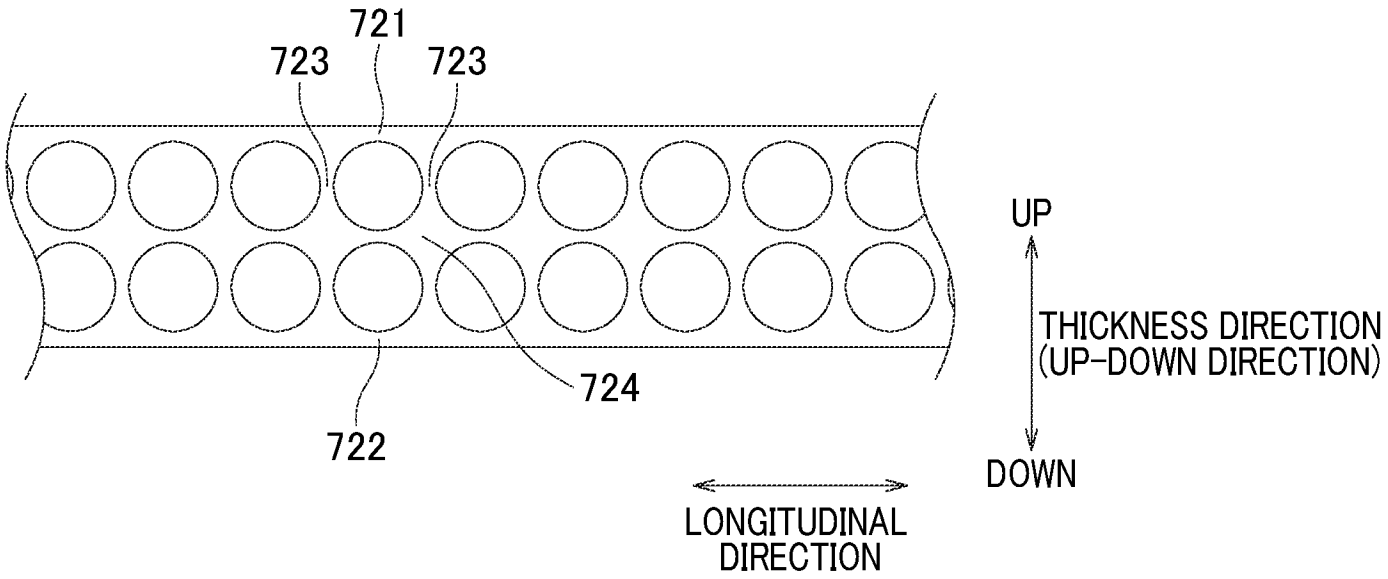
FIG. 15 is a partial cross section cut along the longitudinal direction of a first packing main body of a foundation packing of another modification.

In First Embodiment above, the first packing main body 11 of the foundation packing 1 may be differently structured. FIG. 13 to FIG. 15 show modifications of the first packing main body. Each of FIG. 13 to FIG. 15 is a cross section cut along the longitudinal direction and the up-down direction of the first packing main body. It is noted that the cross sectional surfaces are not hatched in FIG. 13 to FIG. 15.

For example, as shown in FIG. 13, a first foundation packing may have reinforcement diagonal plates (501, 502) which intersect with the longitudinal direction and the thickness direction. Each reinforcement diagonal plate 501 connects a corner portion between the top plate 21 and a vertical plate 23 with a corner portion between the neighboring vertical plate 23 and a reinforcing shelf board 24. The reinforcement diagonal plate 501 and the neighboring reinforcement diagonal plate 502 are arranged to be line-symmetrical about the center line in the up-down direction of the vertical plate 23 which is provided between the reinforcement diagonal plate 501 and the reinforcement diagonal plate 502. Furthermore, the reinforcement diagonal plates (501, 502) above the reinforcing shelf board 24 and the reinforcement diagonal plates below the reinforcing shelf board 24 are arranged to be line-symmetrical about the center line in the longitudinal direction of the reinforcing shelf board 24. Due to the presence of the reinforcement diagonal plates (501, 502), the compressive strength of the foundation packing is improved and the resistance to horizontal quake is improved.

As a further modification, the reinforcement diagonal plates may be provided so that all reinforcement diagonal plates are oriented in the same direction.

As shown in FIG. 14, a reinforcer 601 may be formed at a corner portion between the top plate 21 and a vertical plate 23. Due to the reinforcer 601, the corner portion between the top plate 21 and the vertical plate 23 is not at 90 degrees but is chamfered. A reinforcer 601 is formed at a corner portion between a vertical plate 23 and a reinforcing shelf board 24, too. Due to the reinforcer 601, the corner portion between the vertical plate 23 and the reinforcing shelf board 24 is chamfered. A reinforcer is formed at a corner portion between the bottom plate 22 and a vertical plate 23, too. Due to the reinforcer, the corner portion between the bottom plate 22 and the vertical plate 23 is a chamfered.

As described above, each of the corner portion between the top plate 21 and each vertical plate 23, the corner portion between each vertical plate 23 and each reinforcing shelf board 24, and the corner portion between the bottom plate 22 and each vertical plate 23 may not be at 90 degrees. According to another modification, each corner portion may be rounded in shape.

As shown in FIG. 15, a corner portion between a top plate 721 and a vertical plate 723, a corner portion between a vertical plate 723 and a reinforcing shelf board 724, and a corner portion between a bottom plate 722 and a vertical plate 723 may be rounded. In FIG. 15, ventilation passages that are circular in cross section are provided to form two rows, i.e., an upper row and a lower row. One row of ventilation passages is formed above the reinforcing shelf board 724, and the other row of ventilation passages is formed below the reinforcing shelf board 724.

As described above, the cross sectional shape of each ventilation passage is changeable.

The second packing main body 12 may be changed in a similar manner.

The connectors 3 may be changed in a similar manner, too.

A similar change may be done in Second Embodiment and modifications, too.

In First Embodiment above, as shown in FIG. 6, the intermediate ventilation passage 50 formed in the connector 3 is continuous with the ventilation passage 30 formed in the first packing main body 11 and the ventilation passage formed in the second packing main body 12, in the width direction of the foundation packing 1. In this regard, the intermediate ventilation passage 50 may not be continuous with the ventilation passage 30 formed in the first packing main body 11 and/or the ventilation passage 30 formed in the second packing main body 12, in the width direction of the foundation packing 1.

A similar change may be done in Second Embodiment and modifications, too.

In First Embodiment above, as shown in FIG. 6, the connector 3 is provided with the protrusion 42H for alignment. In this connection, the connector 3 may not be provided with a portion for alignment such as the protrusion 42H.

In First Embodiment above, as shown in FIG. 6, the connector 3 has the protrusion 42H for alignment, at around the center of the second side plate 42. The protrusion 42H has the hole 42*h*. Alternatively, a protrusion for alignment may be formed not at the second side plate 42 but at the center in the width direction of the first side plate 41. This protrusion may have a hole. Alternatively, a protrusion 42H for alignment may be formed at each of the first side plate 41 and the second side plate 42. In place of the protrusion, for example, a mark for alignment may be depicted at the center in the width direction of the first side plate 41 and/or the second side plate 42. The alignment between the foundation packing 1 and a foundation (see the foundation 101 in FIG. 1) can be done using this mark.

In Second Embodiment shown in figures such as FIG. 9, on the connector 303, a protrusion for alignment may be formed or a mark for alignment may be depicted.

In First Embodiment above, as shown in FIG. 2, the top plate cutouts 21*s* and the bottom plate cutouts 22*s* are formed on the outer side in the width direction of the first packing main body 11. In this connection, the first packing main body 11 may not have the top plate cutouts 21*s* and the bottom plate cutouts 22*s*.

The second packing main body 12 may be changed in a similar manner.

A similar change may be done in Second Embodiment and modifications, too.

In First Embodiment above, the top plate cutout 21*s* and the bottom plate cutout 22*s* (see FIG. 2) of the first packing main body 11 are positioned to overlap the connector 3 (see FIG. 6) in the width direction of the foundation packing 1. In this regard, the top plate cutout 21*s* and the bottom plate cutout 22*s* may be positioned not to overlap the connector 3 in the width direction of the foundation packing 1.

The second packing main body 12 may be changed in a similar manner.

A similar change may be done in Second Embodiment and modifications, too.

In First Embodiment above, as shown in FIG. 2, each reinforcing shelf board 24 is substantially in parallel to the top plate 21 and the bottom plate 22 in the first packing main body 11. When the foundation packing 1 is mounted on a foundation (e.g., the foundation 101 shown in FIG. 1), the reinforcing shelf board 24 is more or less horizontal. In this regard, the reinforcing shelf board 24 may not be in parallel to the top plate 21 and/or the bottom plate 22. When the foundation packing 1 is mounted on a foundation, the reinforcing shelf board 24 may not be horizontal.

The connector 3 and the second packing main body 12 may be changed in a similar manner.

A similar change may be done in Second Embodiment and modifications, too.

In First Embodiment, as shown in, for example, FIG. 2, the intervals of the vertical plates 23 are uniform in the longitudinal direction of the foundation packing 1.

In the present invention, the intervals of the vertical plates 23 may be uniform or irregular in the longitudinal direction of the foundation packing 1. The intervals of the vertical plates 23 are only required to be determined in advance.

In First Embodiment and Second Embodiment above, the first packing main body 11 and the second packing main body 12 included in the pair of packing main bodies 2 are structurally identical. In this regard, packing main bodies included in the pair of packing main bodies may be identical or different in structure.

What is claimed is:

1. A foundation packing, which is mounted on a foundation, is provided between the foundation and a building main body constructed above the foundation, and is made of synthetic resin, the foundation packing comprising:

paired long packing main bodies; and connectors which bridge the packing main bodies and are provided between the packing main bodies at intervals in a longitudinal direction of the packing main bodies, each of the packing main bodies including:

a long top plate;

a long bottom plate which is provided below the top plate and is parallel to the top plate;

vertical plates which are provided between the top plate and the bottom plate to stand up to be perpendicular to the top plate and the bottom plate and are at predetermined intervals in a longitudinal direction of the foundation packing; and reinforcing shelf boards which divide ventilation passages into two in an up-down direction, the ventilation passages being formed by the top plate, the bottom plate, and the vertical plates and penetrating each of the packing main bodies in a width direction of the foundation packing.

2. The foundation packing according to claim 1, wherein:

a cross-sectional shape of each of the ventilation passages is vertically long in a thickness direction of the foundation packing, and each of the reinforcing shelf boards is provided at center of height of each of the ventilation passages.

3. The foundation packing according to claim 1, wherein:

each of the connectors has an intermediate ventilation passage which is continuous with a corresponding one of the ventilation passages of each of the packing main bodies, and the intermediate ventilation passages of the connectors have reinforcing shelf boards extending from the reinforcing shelf boards dividing the ventilation passages.

4. The foundation packing according to claim 2, wherein:

each of the connectors has an intermediate ventilation passage which is continuous with a corresponding one of the ventilation passages of each of the packing main bodies, and the intermediate ventilation passages of the connectors have reinforcing shelf boards extending from the reinforcing shelf boards dividing the ventilation passages.

5. The foundation packing according to claim 3, wherein:

each of the connectors has paired side plates which extend from the vertical plates of the packing main bodies and oppose each other, the intermediate ventilation passage is formed between the paired side plates opposing each other, and the intermediate ventilation passages is open top and/or open bottom.

6. The foundation packing according to claim 4, wherein:

each of the connectors has paired side plates which extend from the vertical plates of the packing main bodies and oppose each other, the intermediate ventilation passage is formed between the paired side plate opposing each other, and the intermediate ventilation passages is open top and/or open bottom.

7. A foundation packing, that is mounted on a foundation, is provided between the foundation and a building main body constructed above the foundation, and is made of synthetic resin, the foundation packing comprising:

paired long packing main bodies; and connectors that bridge the packing main bodies and are provided between the packing main bodies at intervals in a longitudinal direction of the packing main bodies, each of the packing main bodies comprising:

a long top plate;

a long bottom plate that is provided below the top plate;

vertical plates that are provided between the top plate and the bottom plate to stand up and are at predetermined intervals in a longitudinal direction of the foundation packing; and reinforcing shelf boards that divide ventilation passages into two in an up-down direction, the ventilation passages being formed by the top plate, the bottom plate, and the vertical plates and penetrating each of the packing main bodies in a width direction of the foundation packing, wherein the reinforcing shelf boards are distanced from outer openings of the ventilation passages, respectively.

8. The foundation packing according to claim 7, wherein:

a cross-sectional shape of each of the ventilation passages is vertically long in a thickness direction of the foundation packing, and each of the reinforcing shelf boards is provided at center of height of each of the ventilation passages.

9. The foundation packing according to claim 7, wherein:

each of the connectors has an intermediate ventilation passage that is continuous with a corresponding one of the ventilation passages of each of the packing main bodies, and the intermediate ventilation passages of the connectors have reinforcing shelf boards extending from the reinforcing shelf boards dividing the ventilation passages.

10. The foundation packing according to claim 8, wherein:

each of the connectors has an intermediate ventilation passage that is continuous with a corresponding one of the ventilation passages of each of the packing main bodies, and the intermediate ventilation passages of the connectors have reinforcing shelf boards extending from the reinforcing shelf boards dividing the ventilation passages.

11. The foundation packing according to claim 9, wherein:

each of the connectors has paired side plates that extend from the vertical plates of the packing main bodies and oppose each other, the intermediate ventilation passage is formed between the paired side plates opposing each other, and the intermediate ventilation passages is open top and/or open bottom.

12. The foundation packing according to claim 10, wherein:

each of the connectors has paired side plates that extend from the vertical plates of the packing main bodies and oppose each other, the intermediate ventilation passage is formed between the paired side plate opposing each other, and the intermediate ventilation passages is open top and/or open bottom.

* * * * *